US012571147B2

(12) United States Patent
Djerekarov et al.

(10) Patent No.: US 12,571,147 B2
(45) Date of Patent: Mar. 10, 2026

(54) COMBINATION LAUNDRY APPLIANCE AND METHOD FOR SPIN ASSISTED DRYING CYCLE

(71) Applicant: Haier US Appliance Solutions, Inc., Wilmington, DE (US)

(72) Inventors: Jivko Ognianov Djerekarov, Louisville, KY (US); David Scott Dunn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 203 days.

(21) Appl. No.: 18/350,394

(22) Filed: Jul. 11, 2023

(65) Prior Publication Data

US 2025/0019883 A1 Jan. 16, 2025

(51) Int. Cl.

| | |
|---|---|
| ***D06F 33/68*** | (2020.01) |
| ***D06F 25/00*** | (2006.01) |
| ***D06F 33/60*** | (2020.01) |
| *D06F 105/30* | (2020.01) |

(Continued)

(52) U.S. Cl.

CPC ..... *D06F 33/68* (2020.02); *D06F 25/00* (2013.01); *D06F 33/60* (2020.02); *D06F 2105/30* (2020.02); *D06F 2105/48* (2020.02); *D06F 2105/52* (2020.02)

(58) Field of Classification Search

CPC ..... D06F 25/00; D06F 33/40; D06F 33/48; D06F 33/60; D06F 33/63; D06F 33/68; D06F 33/70; D06F 33/72; D06F 33/74; D06F 58/206; D06F 58/30; D06F 58/40; D06F 58/46; D06F 58/48; D06F 2105/26; D06F 2105/30; D06F 2105/48; D06F 2105/52

See application file for complete search history.

(56) References Cited

U.S. PATENT DOCUMENTS

2003/0056302 A1* 3/2003 Broker ..... D06F 34/16 8/159
2005/0044744 A1* 3/2005 Tadano ..... D06F 58/206 34/596

(Continued)

FOREIGN PATENT DOCUMENTS

JP 2018033842 A * 3/2018 ..... D06F 58/02
WO WO2020102918 A1 5/2020

OTHER PUBLICATIONS

Machine Translation of Ninomiya et al., JP-2018033842-A, Mar. 2018. (Year: 2018).*

*Primary Examiner* — David G Cormier
(74) *Attorney, Agent, or Firm* — Dority & Manning, P.A.

(57) ABSTRACT

A combination washer/dryer laundry appliance is provided, including a cabinet defining an interior volume, a tub mounted within the interior volume of the cabinet, a laundry basket rotatably mounted within the tub, the laundry basket defining a chamber for the receipt of laundry articles, and a dryer system coupled to the tub. The dryer system is in fluid communication with the chamber and configured to receive a flow of fluid from the chamber and remove moisture from the flow of fluid and provide dried air to the chamber. The laundry appliance configured to perform, at the laundry basket, a spin cycle, and operate the dryer system prior to completion of performing the spin cycle.

11 Claims, 7 Drawing Sheets

(51) Int. Cl.
*D06F 105/48* (2020.01)
*D06F 105/52* (2020.01)

(56) References Cited

U.S. PATENT DOCUMENTS

| | | | |
|---|---|---|---|
| 2012/0036650 | A1 | 2/2012 | Hong et al. |
| 2022/0290354 | A1 | 9/2022 | Lee et al. |

* cited by examiner

COMBINATION LAUNDRY APPLIANCE AND METHOD FOR SPIN ASSISTED DRYING CYCLE

FIELD OF THE INVENTION

The present subject matter relates generally to laundry appliances and more particularly to combination laundry appliances that perform both washing and drying operations.

BACKGROUND OF THE INVENTION

Combination laundry appliances sometimes also referred to as washer/dryer appliances, provide both washing and drying functions in a single unit. Combination laundry appliances are therefore advantageous for added convenience and space saving.

Combination washer/dryer laundry appliances are configured to perform a wash cycle and generally includes a spin cycle. However, inefficient spin cycles may result in relatively high moisture content remaining in the laundry articles, requiring a longer spin cycle to remove moisture, a longer drying cycle to dry articles, or both. Increased cycle times generally result in undesired increases in energy consumption.

Additionally, a spin cycle may be interrupted by laundry load unbalance, such as from moisture-laden laundry articles. Such interruptions may require manual corrections, such as manually re-distributing laundry articles. Furthermore, such interruptions may stall the overall wash and dry cycle until manual intervention is performed.

Accordingly, a combination laundry appliance addressing such issues would be beneficial and advantageous.

BRIEF DESCRIPTION OF THE INVENTION

Aspects and advantages of the invention will be set forth in part in the following description, or may be obvious from the description, or may be learned through practice of the invention.

An aspect of the present disclosure is directed to a combination washer/dryer laundry appliance, including a cabinet defining an interior volume, a tub mounted within the interior volume of the cabinet, a laundry basket rotatably mounted within the tub, the laundry basket defining a chamber for the receipt of laundry articles, and a dryer system coupled to the tub. The dryer system is in fluid communication with the chamber. The dryer system is configured to receive a flow of fluid from the chamber and remove moisture from the flow of fluid and provide dried air to the chamber. A controller is configured to store instructions that, when executed, causes the controller to execute operations. The operations include performing, at the laundry basket, a spin cycle corresponding to a wash cycle, and operating the dryer system prior to completion of performing the spin cycle.

Another aspect of the present disclosure is directed to a method for operating a combination washer/dryer laundry appliance. The method includes performing, at a laundry basket, a spin cycle corresponding to a wash cycle, wherein performing the spin cycle includes rotating the laundry basket up to a wash cycle maximum spin speed; and operating the dryer system prior to completion of performing the spin cycle to provide heated air to the chamber at the laundry basket during the spin cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
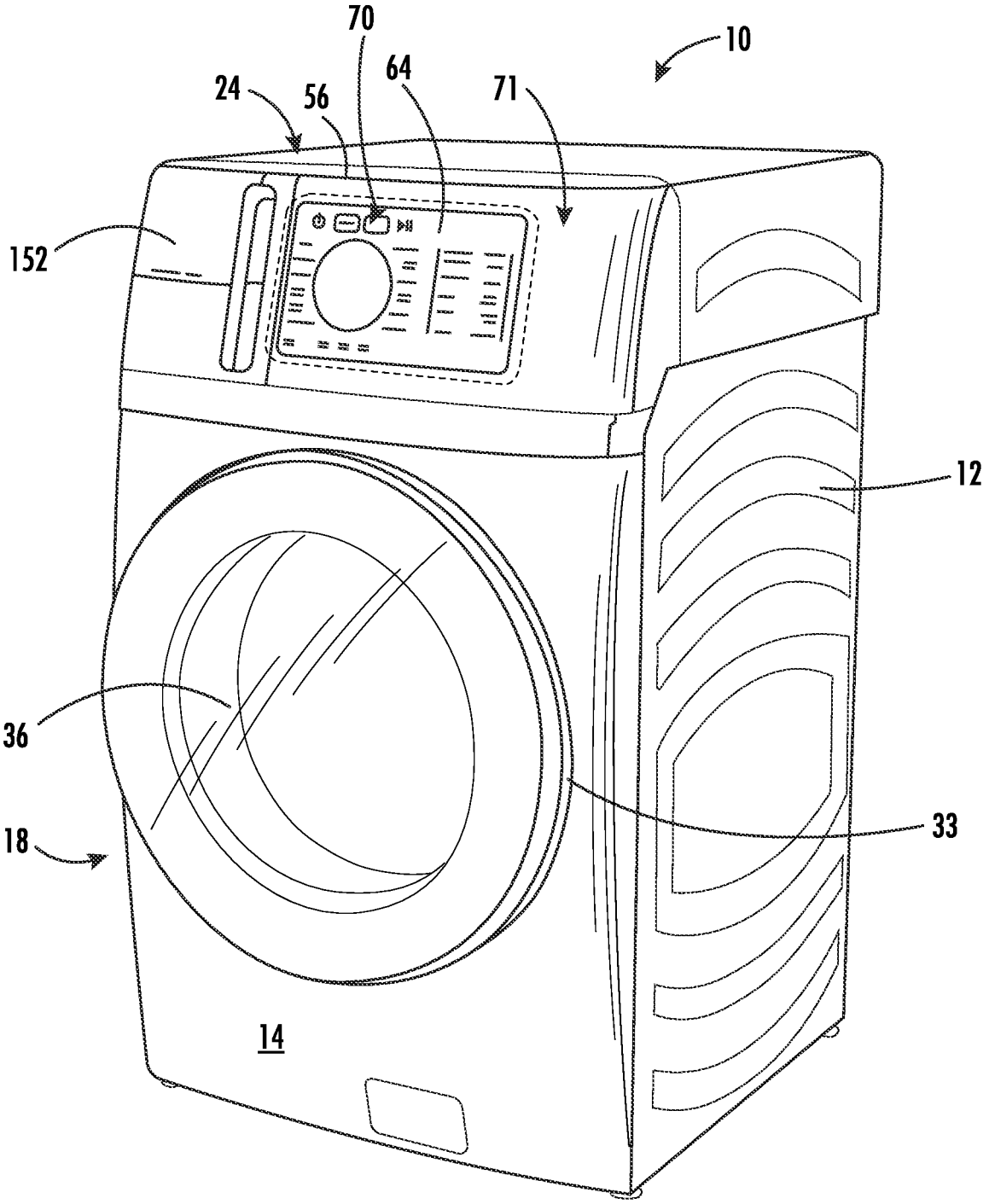
FIG. 1 provides a perspective view of a laundry appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
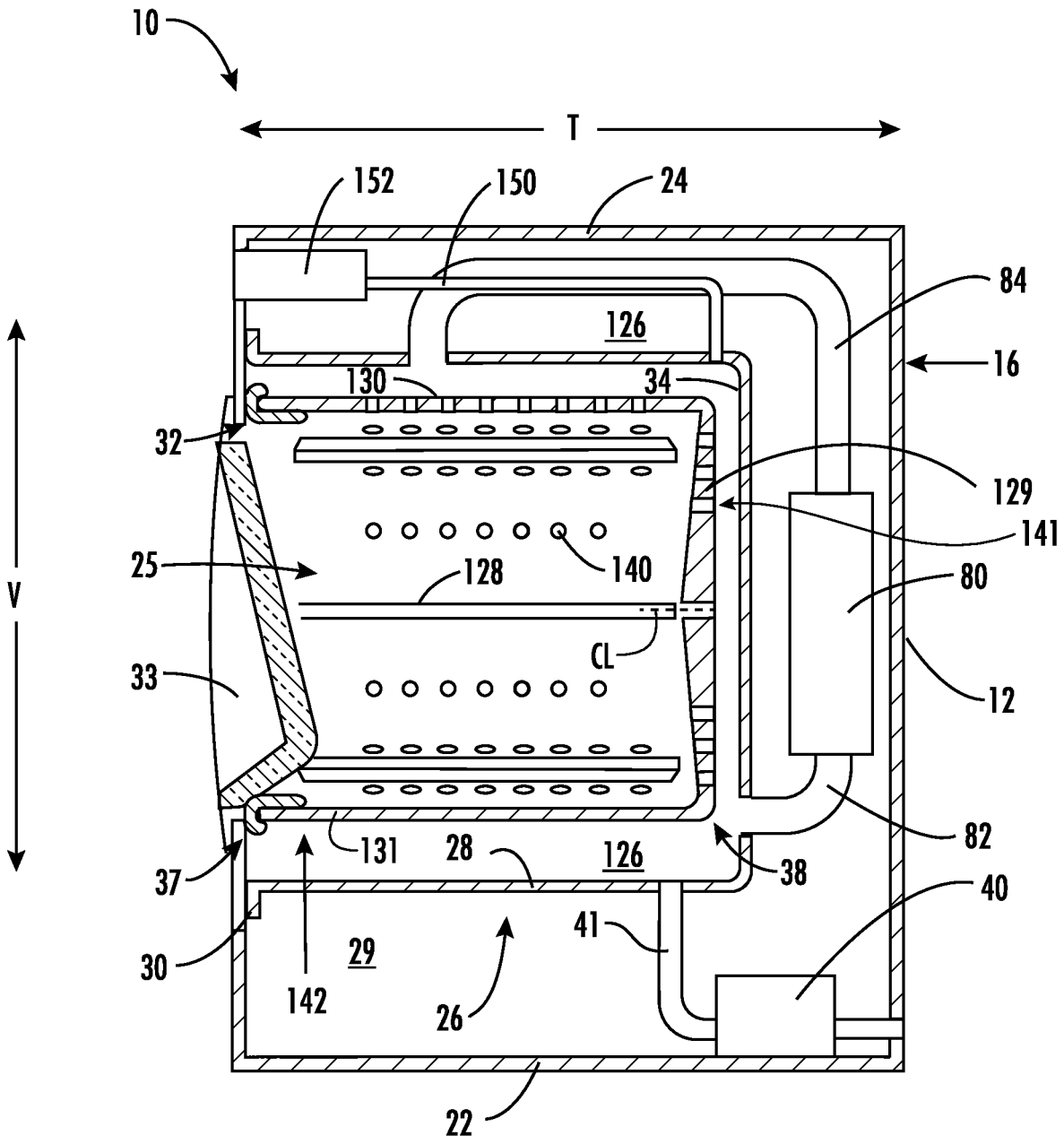
FIG. 2 provides a cross-section view of the example laundry appliance of FIG. 1.

Turning now to the figures, FIG. 1 provides a perspective view of a laundry appliance 10 according to exemplary embodiments of the present disclosure. The laundry appliance 10 is a combination laundry appliance, and may also be referred to as a multifunction laundry appliance or washer/dryer combination appliance. FIG. 2 provides a section view of laundry appliance 10. The laundry appliance 10 generally defines a vertical direction V, a lateral direction L, and a transverse direction T, each of which is mutually perpendicular, such that an orthogonal coordinate system is defined. While described in the context of a specific embodiment of laundry appliance 10, using the teachings disclosed herein, it will be understood that laundry appliance 10 is provided by way of example only. Other laundry appliances having different appearances and different features may also be utilized with the present subject matter as well.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

Cabinet 12 includes a front panel 14, a rear panel 16, a left side panels 18 and a right side panel 20 spaced apart from each other by front and rear panels 14 and 16, a bottom panel 22, and a top cover 24. As used herein, terms such as "left" and "right" or "front" and "back" refer to directions from the perspective of a user facing the laundry appliance 10 for accessing and/or operating the laundry appliance 10. For example, a user stands in front of the laundry appliance 10, e.g., at or near the front panel 14, to access door 33 and/or inputs 70 (the door 33 and inputs 70 are described in more detail below). Within cabinet 12, an interior volume 29 is defined. A drum or tub 26 is mounted within the interior volume 29. A laundry basket 130 is mounted within the tub 26. The laundry basket 130 defines a chamber 25 for receipt of articles of clothing for treatment, e.g., washing, rinsing, spinning, tumbling, and/or drying.

In some embodiments, one or more selector inputs 70, such as knobs, buttons, touchscreen interfaces, etc., may be provided or mounted on the cabinet 12, e.g., on a control panel 71 thereof and are in operable communication (e.g., electrically coupled or coupled through a wireless network band) with a processing device or controller 56. The control panel 71 may also include a display 64. Controller 56 may also be provided in operable communication with various components of the washer/dryer appliance 10, such as the motor, blower, and/or dryer system 80. In turn, signals generated in controller 56 direct operation of such components in response to the position of inputs 70. As used herein, "processing device" or "controller" may refer to one or more microprocessors, microcontroller, ASICS, or semiconductor devices and is not restricted necessarily to a single element. The controller 56 may be programmed to operate laundry appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

Tub 26 extends between a front portion 37 and a back portion 38. Tub 26 is generally cylindrical in shape, having an outer cylindrical wall 28 and a front flange or wall 30 that defines an opening 32 of tub 26, e.g., at front portion 37 of tub 26, for loading and unloading of articles into and out of a chamber 25 defined by and within a laundry basket 130 inside of the tub 26. Tub 26 includes a rear wall 34 opposite the front flange 30. A door 33 provides for closing or accessing tub 26 through opening 32. A window 36 (FIG. 1) may be provided in door 33 for viewing of the chamber 25 and/or laundry articles therein, e.g., during operation of the laundry appliance 10.

Laundry basket 130 is rotatably mounted within tub 26 such that the laundry basket 130 is rotatable about an axis of rotation CL. According to the illustrated embodiment, the axis of rotation is substantially parallel to the transverse direction T. In this regard, laundry appliance 10 is generally referred to as a "horizontal axis" or "front load" laundry appliance 10. However, it should be appreciated that aspects of the present subject matter may be used within the context of a vertical axis or top load laundry appliance as well.

Laundry appliance 10 includes a motor assembly (not shown) that is in mechanical communication with laundry basket 130 to selectively rotate laundry basket 130. The motor assembly may be a pancake motor or any other suitable type, size, or configuration of motor may be used to rotate laundry basket 130 according to various embodiments.

Laundry basket 130 includes a rear wall 129 extending along the vertical direction V and a sidewall 131 extending from the rear wall 129 along the transverse direction T. Laundry basket 130 may define one or more agitator features that extend into chamber 25 to assist in agitation and cleaning of articles disposed within laundry chamber 25 during operation of laundry appliance 10. For example, as illustrated in FIG. 2, a plurality of ribs 128 extends from laundry basket 130 into chamber 25. In this manner, for example, ribs 128 may lift articles disposed in laundry basket 130 during rotation of laundry basket 130, such as during an agitation or rinse portion of a wash operation of the laundry appliance 10. During a drying operation of the laundry appliance 10, the ribs 128 may also lift articles in the chamber 25 of the laundry basket 130 and then allow such articles to tumble back to a bottom of laundry basket 130 as laundry basket 130 rotates.

Figure 3:
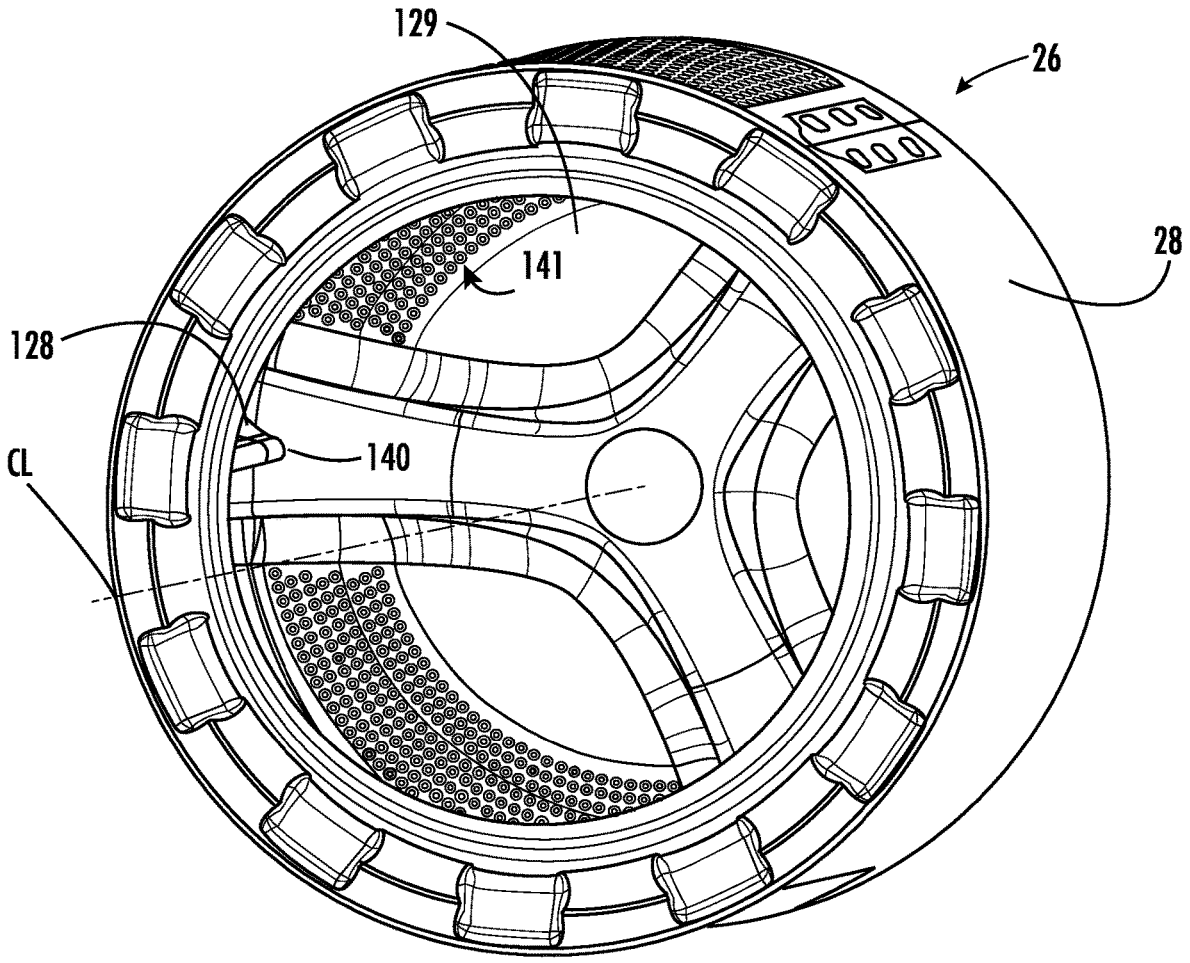
FIG. 3 provides a perspective view of an exemplary drum of the laundry appliance according to one or more embodiments of the present disclosure.
Figure 4:
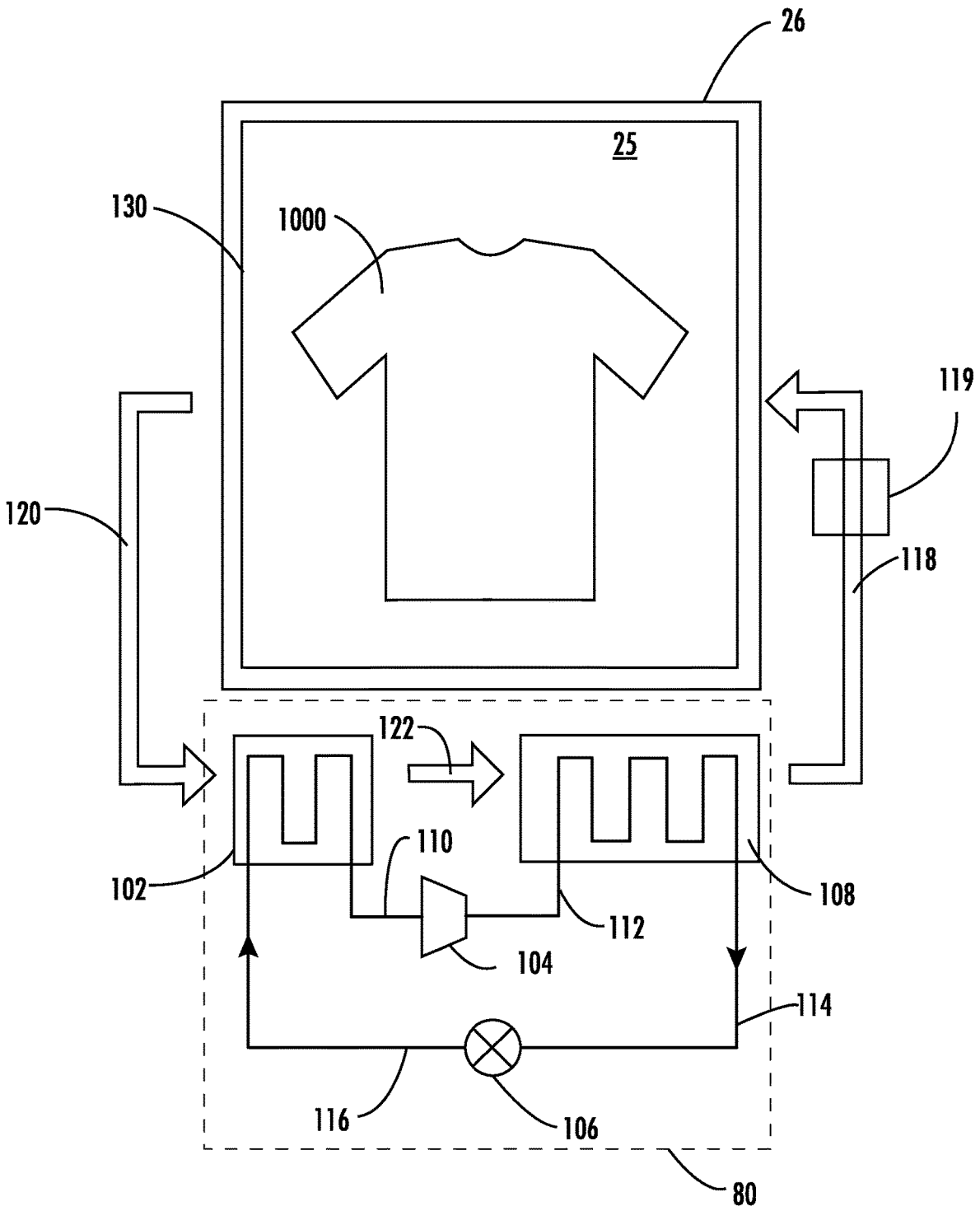
FIG. 4 provides a schematic diagram of an exemplary laundry appliance according to one or more embodiments of the present disclosure.

As illustrated for example in FIGS. 2-4, laundry basket 130 includes a plurality of sidewall perforations 140 extending through sidewall 232, rib 128, or both, in order to facilitate fluid communication between chamber 25 and tub 26, e.g., whereby wash liquid may flow between the tub 26 and the chamber 25 during a wash operation or cycle and/or heated air may flow into the chamber 25 and moisture-laden air may flow out of the chamber 25 during a drying operation or cycle.

Laundry basket 130 includes a plurality of rear wall perforations 141 extending through the rear wall 129. Perforations 140, 141 provide fluid communication from a plenum 126 between the laundry basket 130 and the tub 26. In some embodiments, the plurality of rear wall perforations 141 is positioned between a first radius and a second radius relative to the axis of rotation CL. The second radius forms an outer radius proximate to the sidewall 131. The first radius forms an inner radius distal to the sidewall 131 and more proximate to the axis of rotation CL. In various embodiments, the plurality of rear wall perforations 141 is formed in a region formed between the first radius and the second radius extending at least 50% of a radial distance from the axis of rotation CL to the sidewall 131. For instance, the first radius to second radius may extend between approximately 50% to approximately 100% of the radial distance between the axis of rotation CL and the sidewall 131. In another embodiment, the first radius to the second radius may extend between approximately 60% to approximately 99% of the radial distance between the axis of rotation CL and the sidewall 131. In still various embodiments, the rear wall 129 is non-perforated (e.g., solid or otherwise non-fluidly communicating) in a region between the first radius and the axis of rotation.

A sump 142 is defined by tub 26 outside of laundry basket 130 at a bottom of the tub 26 along the vertical direction V. For instance, sump 142 may be defined between the cylindrical wall 28 and the sidewall 131 of the laundry basket 130. Thus, sump 142 is configured for receipt of, and generally collects, wash liquid (the wash liquid may include, e.g., water, and may also includes additives such as detergents, etc.) during wash operations of laundry appliance 10. For example, during a wash operation of laundry appliance 10, wash liquid may be urged (e.g., by gravity) from the chamber 25 within the laundry basket 130 to sump 142 through the plurality of perforations 140. A pump assembly 40 is located beneath tub 26 for gravity assisted flow when draining tub 26 (e.g., via a drain 41). Pump assembly 40 is also configured for recirculating wash liquid within tub 26.

In some embodiments, laundry appliance 10 includes an additive dispenser or spout 150. For example, spout 150 may be in fluid communication with a water supply (not shown) in order to direct fluid (e.g., clean water) into tub 26. Spout 150 may also be in fluid communication with the sump 142. For example, pump assembly 40 may direct wash liquid disposed in sump 142 to spout 150 in order to circulate wash liquid in tub 26.

As illustrated, a detergent drawer 152 may be slidably mounted within front panel 14. Detergent drawer 152 receives an additive (e.g., detergent, fabric softener, bleach, or any other suitable liquid or powder) and directs the additive to chamber 25 during operation of laundry appliance 10. According to the illustrated embodiment, detergent drawer 152 may also be fluidly coupled to spout 150 to facilitate the complete and accurate dispensing of the additive.

Figure 5:
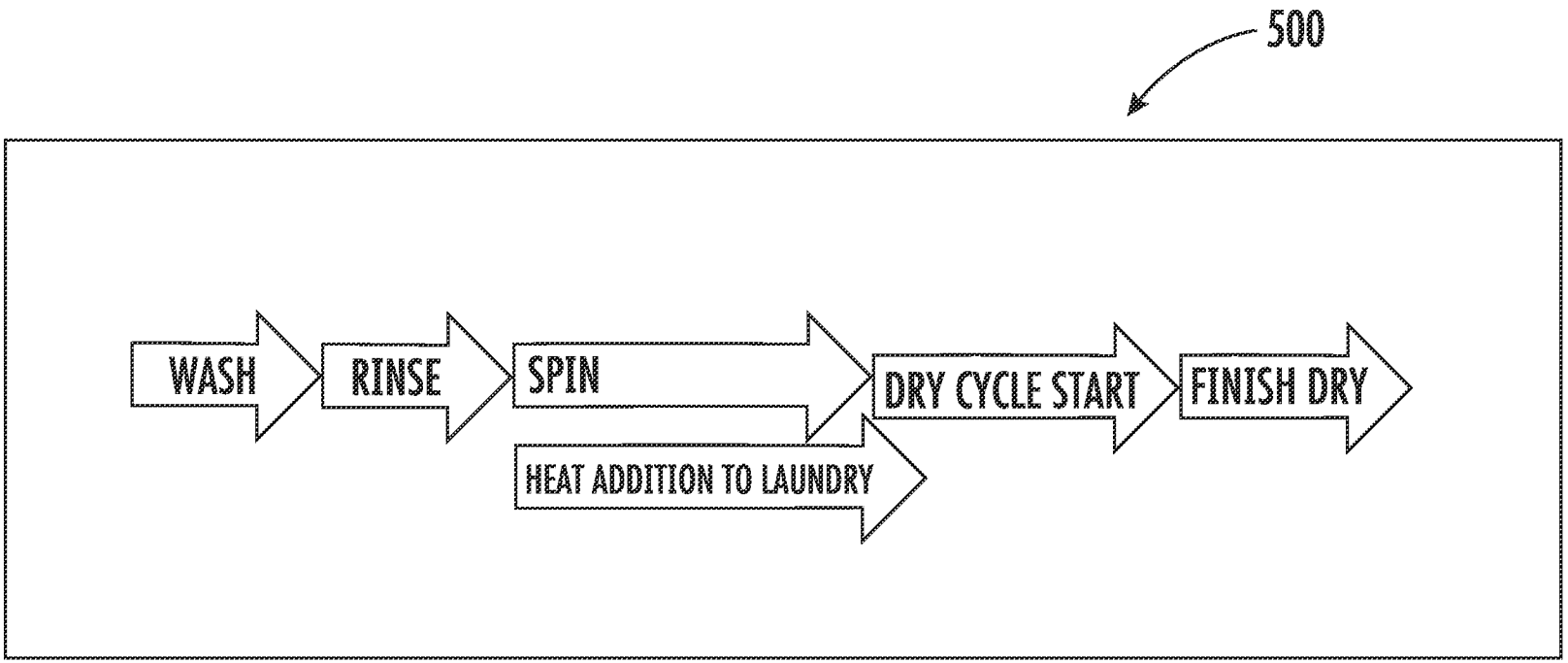
FIG. 5 provides a schematic diagram outlining steps of a method for operating a combination washer/dryer laundry appliance accordingly to one or more embodiments of the present disclosure.

Referring to FIG. 5, a schematic diagram 500 outlines steps of an exemplary wash and dry cycle for the laundry appliance 10. In exemplary embodiments, laundry items are loaded into laundry basket 130 through opening 32, and an operation is initiated through operator manipulation of input selectors 70. For example, a wash cycle may be initiated such that tub 26 is filled with water, detergent, or other fluid additives (e.g., via spout 150). One or more valves (not shown) can be controlled by laundry appliance 10 to provide for filling laundry basket 130 to the appropriate level for the amount of articles being washed or rinsed. By way of example, once laundry basket 130 is properly filled with fluid, the contents of laundry basket 130 can be agitated (e.g., with ribs 128) for an agitation phase of laundry items in laundry basket 130. During the agitation phase, the basket 130 may be motivated about the axis of rotation at a set speed (e.g., a tumble speed). As the basket 130 is rotated, articles within the basket 130 may be lifted and permitted to drop therein.

After the agitation phase of the washing operation is completed, tub 26 can be drained. Laundry articles can then be rinsed (e.g., through a rinse cycle) by again adding fluid to tub 26, depending on the particulars of the cleaning cycle selected by a user. Ribs 128 may again provide agitation within laundry basket 130. One or more spin cycles may also be used. In particular, a spin cycle may be applied after the wash cycle or after the rinse cycle in order to wring wash liquid from the articles being washed. During a spin cycle, basket 130 is rotated at relatively high speeds. For instance, basket 130 may be rotated at one set speed (e.g., a pre-plaster speed) before being rotated at another set speed (e.g., a plaster speed). As would be understood, the pre-plaster speed may be greater than the tumble speed and the plaster speed may be greater than the pre-plaster speed. Moreover, agitation or tumbling of articles may be reduced as basket 130 increases its rotational velocity such that the plaster speed maintains the articles at a generally fixed position relative to basket 130.

During at least a portion of the spin cycle, the dryer system 80 is operated to provide heated air 118 (FIG. 4) to the chamber 25. For instance, a compressor 104 at the dryer system 80 is activated during the spin cycle to raise the temperature of air cycling through a flowpath including the dryer system 80 and chamber 25. In various embodiments, operation of the compressor 104 commences at a predetermined period before the end of the spin cycle or prior to commencing the drying cycle. In various embodiments, operation of the compressor 104 allows the temperature of the air 118 cycling through the chamber 25 to be raised gradually while the spin cycle is in progress. Accordingly, a portion of the drying cycle that is raising the temperature of the air occurs in parallel with the spin cycle, allowing for a reduced period of time of the washer/drying cycle of the overall wash/dry cycle.

After the spin cycle, the temperature of air for the drying operation is already achieved by the end of the spin cycle. A supply duct 82 may be mounted to tub 26 and may extend between tub 26 and a heating assembly or system 80, whereby the tub 26 is downstream of the dryer system 80 along the supply duct 82 such that the dryer system 80 supplies heated air that has been heated by the dryer system 80 to the tub 26 via the supply duct 82 or otherwise removes moisture, such as via a heat exchanger or evaporator 102, filters, or combinations thereof. A return duct 84 may also be mounted to the tub 26 and may extend between tub 26 and the dryer system 80 whereby the tub 26 is upstream of the dryer system 80 along the return duct 84 such that the dryer system 80 receives relatively moist, humid, air from the tub 26 via the return duct 84, e.g., air returns to the dryer system 80 from the tub 26, e.g., after flowing over and around articles within the chamber 25, through the return duct 84. The supply duct 82 may be mounted to the tub 26, e.g., at the rear wall 34 thereof as in the illustrated example, or the supply duct 82 may be mounted to the cylindrical wall 28 of the tub 26, such as above the basket 130, similar to the return duct 84 in the illustrated example embodiment.

The dryer system 80, may include, e.g., a heating element, a gas burner, and/or a heat pump, such as the example heat pump embodiment illustrated in FIG. 4 and described in more detail below. Moisture laden air is drawn from tub 26 by an air handler, such as a blower fan (e.g., blower 119), which generates a negative air pressure within the chamber 25. As the air passes from the blower fan, it enters return duct 84 and then is passed into dryer system 80. Dry and/or heated air (with a lower moisture content than was received from tub 26), exits dryer system 80 and is supplied to tub 26 by supply duct 82. When operated during a drying cycle, after the clothing articles have been dried, they are removed from the chamber 25 via opening 32. As provided further herein, portions of the dryer system 80 may be operated to generate the negative air pressure to urge the flow of fluid (e.g., a flow of air) from the chamber 25 through the dryer system 80 to remove moisture content from the flow of fluid during the spin cycle.

FIG. 4 provides a schematic view of selected components of one or more exemplary embodiments of laundry appliance 10. In particular, FIG. 4 illustrates components used during drying operations of the laundry appliance 10. It is understood that, except as otherwise indicated, laundry appliance 10 in FIG. 4 may include some or all of the features described above with respect to FIGS. 1-3.

In operation, one or more laundry articles 1000 may be placed within the chamber 25 of laundry basket 130. Dry air 118 (e.g., hot dry air during operation of the drying cycle, or dry air during operation of the spin cycle) may be supplied to chamber 25 whereby moisture within laundry articles 1000 may be drawn from the laundry articles 1000 by evaporation, such that warm saturated air 120 may flow from chamber 25 to a heat exchanger or evaporator 102 of the dryer system 80, e.g., via the return duct 84 illustrated in FIG. 2. As air passes across evaporator 102, the temperature of the air is reduced through heat exchange with refrigerant that is vaporized within, for example, coils or tubing of evaporator 102. This vaporization process absorbs both the sensible and the latent heat from the moisture laden air-thereby reducing its temperature. As a result, moisture in the air is condensed and such condensate may be drained from dryer system 80, as will be understood by those of ordinary skill in the art.

Air passing over evaporator 102 becomes drier and cooler than when it was received from tub 26 of laundry appliance 10. As shown, cool dry air 122 from evaporator 102 is subsequently caused to flow across a condenser 108 (e.g., across coils or tubing of the condenser 108), which condenses refrigerant therein. The refrigerant enters condenser 108 in a gaseous state at a relatively high temperature compared to the air 122 from evaporator 102. As a result, heat energy is transferred to the air at the condenser section 108, thereby elevating the temperature of the air and providing warm dry air 118 for supply to the tub 26 of washer/dryer appliance 10. e.g., via the supply duct 82 illustrated in FIG. 2. The warm dry air 118 passes over and around laundry articles 1000 within the chamber 25 of the tub 26, such that warm saturated air 120 is generated, as mentioned above. For example, the warm dry air may circulate around and through the articles 1000 while the articles 1000 are tumbled within the chamber 25 such as by rotating the basket 130, and the tumbling may be promoted by ribs 128 as well. Because the air is recycled through tub 26 and dryer system 80, laundry appliance 10 can have a much greater efficiency than traditional clothes dryers where warm, moisture laden air is exhausted to the environment.

As shown, some embodiments of dryer system 80 include a compressor 104 that pressurizes refrigerant (i.e., increases the pressure of the refrigerant) supplied by suction line 110 and generally motivates refrigerant through the sealed refrigerant circuit of dryer system 80. Compressor 104 may be in operable communication with controller 56 and is generally designed to pressurize a gas phase refrigerant. Accordingly, in order to avoid damage, refrigerant in suction line 110 is supplied to the compressor 104 in a gas phase from the evaporator section 102. The pressurization of the refrigerant with compressor 104 increases the temperature of the refrigerant (e.g., as directed by controller 56). The compressed refrigerant is fed from compressor 104 to condenser 108 through line 112. As relatively cool air 122 from the evaporator 102 is passed over the condenser 108, the refrigerant is cooled and its temperature is lowered as heat is transferred to the air for supply to tub 26.

Upon exiting condenser 108, the refrigerant is fed through line 114 to an expansion device 106. Although only one expansion device 106 is shown, such is by way of example only. It is understood that multiple such devices may be used. In the illustrated example, expansion device 106 is a thermal expansion valve. In additional embodiments, any other suitable expansion device, such as a capillary tube, may be used as well as or instead of the thermal expansion valve 106. Expansion device 106 lowers the pressure of the refrigerant and controls the amount of refrigerant that is allowed to enter the evaporator 102 via line 116. Importantly, the flow of liquid refrigerant into evaporator 102 is limited by expansion device 106 in order to keep the pressure low and allow expansion of the refrigerant back into the gas phase in the evaporator 102. The evaporation of the refrigerant in the evaporator 102 converts the refrigerant from its liquid-dominated phase to a gas phase while cooling and drying the air 120 from tub 26. The process is repeated as air is circulated through tub 26 and between evaporator 102 and condenser 108 while the refrigerant is cycled through the sealed refrigerant circuit, as described above.

Figure 6:
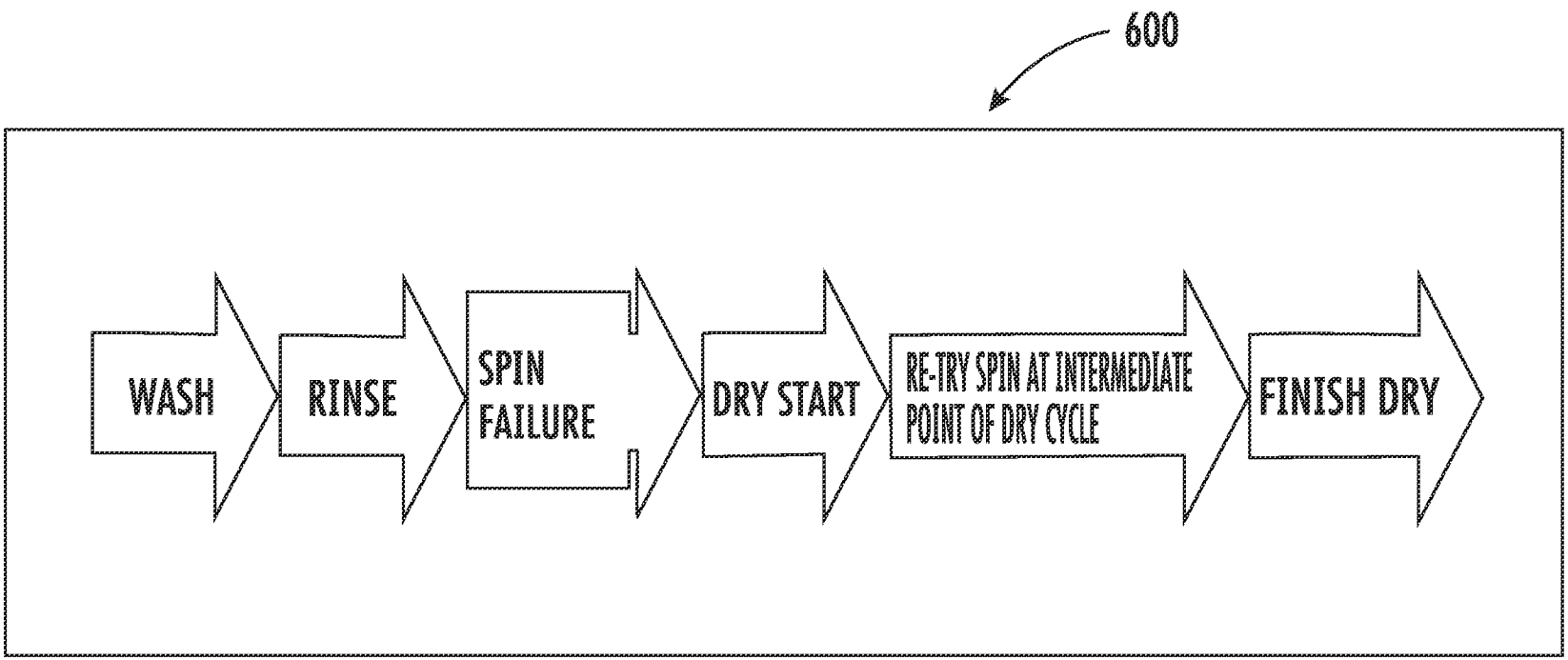
FIG. 6 provides a schematic diagram outlining steps of a method for operating a combination washer/dryer laundry appliance accordingly to one or more embodiments of the present disclosure.

Referring now to FIG. 6, a schematic diagram 600 depicting an exemplary operation of the washer/dryer appliance 10 is provided. In some embodiments, the laundry appliance 10 is configured to detect laundry load unbalance during the spin cycle indicative of spin cycle failure. Spin cycle failure may include exceeding a threshold limit of relative humidity at the chamber 25, accelerometer loading (i.e., during rotation of the laundry basket 130), or motor power usage to spin the laundry basket 130. When spin cycle failure is detected, the laundry appliance 10 is configured to pause or discontinue the spin cycle and commence the drying cycle for a predetermined period of time. The laundry appliance 10 is configured to re-start the spin cycle after a predetermined period of flowing heated air to the chamber 25 in the drying cycle. It should be appreciated that the drying cycle rotates the laundry basket 130 up to up to a dryer cycle maximum speed, in contrast to a wash cycle maximum spin speed less than the wash cycle maximum spin speed. In various embodiments, the dryer cycle maximum speed is up to approximately 500 revolutions per minute (RPM) or equivalent to approximately 1 g acceleration, and the wash cycle maximum spin speed is up to approximately 1300 RPM. However, it should be appreciated that one skilled in the art may include lower or higher maximum speeds for the respective dryer cycle and spin cycle (e.g., greater or lesser than 500 RPM and greater than lesser than 1300 RPM, respectively, while including the maximum dryer cycle speed less than the maximum spin cycle speed). For example, dryer spin speed may be configured to carry the load of clothing articles to the top of the tub and have it free fall through the tub, such as to allow for fluff and uniform drying. As another example, wash cycle spin speed may be a function of diameter of the wash basket (e.g., smaller diameter wash baskets may spin at greater speeds than larger diameter wash baskets).

Figure 7:
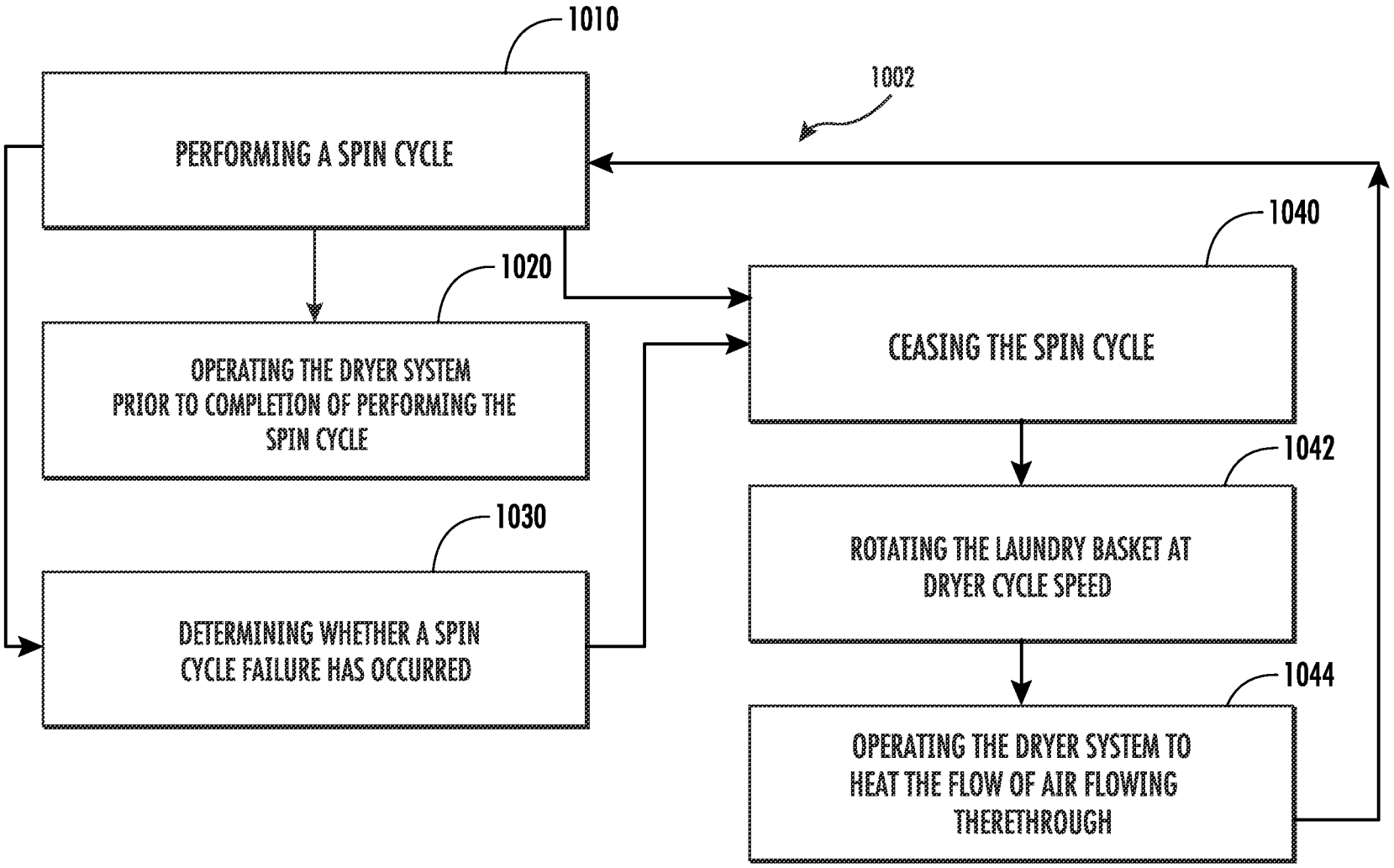
FIG. 7 provides a flowchart outlining steps of a method for operating a combination washer/dryer appliance in accordance with aspects of the present disclosure.

Referring now to FIG. 7, a flowchart outlining exemplary steps of a method for operating a combination washer/dryer appliance is provided (hereinafter, "method 1002"). Embodiments of method 1002 may be stored as instructions at controller 56 and executed by embodiments of the laundry appliance 10 such as depicted and described herein. Embodiments of the method 1002 described herein may improve the spin cycle at a combination washer/dryer laundry appliance (e.g., laundry appliance 10), such as to improve moisture reduction of laundry articles by the spin cycle. Embodiments of the method 1002 may additionally, or alternatively, provide for spin cycle recovery after a spin cycle failure, such as due to load unbalance.

Embodiments of the method 1002 include at 1010 performing a spin cycle corresponding to a wash cycle. Performing the spin cycle includes operating a motor to rotate the laundry basket (e.g., laundry basket 130) up to a wash cycle maximum spin speed, such as up to approximately 1300 RPM. Prior to completion of the spin cycle, method 1002 includes at 1020 operating the dryer system (e.g., dryer system 80) to heat the flow of air flowing therethrough. In some embodiments, operating the dryer system to heat the flow of air prior to completion of the spin cycle comprises operating the dryer system up to approximately 15 minutes prior to completion of the spin cycle. For instance, the period of time prior to completion of the spin cycle may generally correspond to a period of time to ramp up a temperature of air flowing through the dryer system due to performing the spin cycle to a desired heated temperature.

During operation of the method 1002, rotation of the laundry basket during the spin cycle generates a flow of air through the chamber (e.g., chamber 25) and dryer system (e.g., dryer system 80). A flowrate of air generated by the spin cycle is generally different (e.g., less than) a flowrate of air generated by the blower (e.g., blower 119) at the dryer system to push or draw heated, dry air (e.g., air 118) through the flowpath including the chamber and the dryer system.

It should be appreciated that a power or voltage requirement to rotate the laundry basket during the spin cycle is different (e.g., greater) than a power or voltage requirement to rotate the laundry basket during the drying cycle. Accordingly, operation of all components of the dryer system may be inhibited. Embodiments of the method 1002 at 1020 may particularly include operating the compressor (e.g., compressor 102), such as to drive heat exchange of the air flowing through the dryer system and heat the air flowing therethrough. For instance, operating the dryer system may include operating only the compressor, or generally operating the dryer system without operating the blower. As described above, rotation of the laundry basket at spin cycle speeds may generate sufficient airflow to drive the heated air to the chamber and through the dryer system. Accordingly, operation of the blower (e.g., blower 119) may be ceased or discontinued, such as to avoid excessive power or voltage draw and avoid circuit breaking.

Embodiments of the method 1002 may include at 1030 determining whether a spin cycle failure has occurred. Determining spin cycle failure may include any appropriate method, including determining whether an unbalance threshold is exceeded, determining whether a moisture content limit is exceeded, or determining whether a power usage at the motor is exceeded. When a spin cycle failure has occurred, method 1002 includes performing one or more iterations of at 1040 pausing, discontinuing, or otherwise ceasing the spin cycle (i.e., ceasing rotation or decreasing rotational speed of the laundry basket from up to the wash cycle maximum spin speed), at 1042 rotating the laundry basket at drying cycle speed up to a dryer cycle maximum speed (e.g., up to approximately 50 RPM to 500 RPM or equivalent to 1 g acceleration), and at 1044 operating the dryer system to heat the flow of air flowing therethrough, such as described in regard to step 1020. For instance, method 1000 may include decreasing rotational speed of the laundry basket from above the dryer cycle maximum speed (e.g., between the dryer cycle maximum speed and the wash cycle maximum spin speed) to less than or equal to the dryer cycle maximum speed (e.g., greater than zero RPM and up to the dryer cycle maximum speed).

In various embodiments, step 1044 is performed for a predetermined period of time, such as to remove at least a portion of the moisture to reduce the load at the laundry articles. The reduced load may reduce the unbalance condition at the laundry articles, such as to allow for continuing the spin cycle (i.e., up to the wash cycle maximum spin speed). Accordingly, method 1002 may include performing or continuing step 1010 and re-performing step 1030 after performing steps 1040, 1042, 1044, such as to determine whether the spin cycle failure is, or still has, occurred. Method 1002 may include performing one or more iterations of steps 1030, 1040, 1042, and 1044. When the spin cycle failure condition is removed, method 1002 may include at 1050 completing the spin cycle and at 1052 performing the drying cycle.

Embodiments of the washer/dryer appliance 10 and method 1002 provided herein may improve efficiency and performance of combination washer/dryer appliances by reducing moisture content from laundry articles during the spin cycle. Reduced moisture content may allow for reduced drying times and reduced energy consumption (e.g., reduced thermal input, reduced spin cycle time, reduced dryer tumble time, reduced cycle times generally, etc.). Embodiments of the method 1002 may unexpectedly utilize a portion of the dryer system 80, such as the compressor 102, to generate heat to the flow of air therethrough, without operating the blower 119, allowing for reduced energy consumption and allowing for operation of the dryer system 80 during operation of the spin cycle, such as to improve spin cycle performance, overcome spin cycle failure, or both.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combination washer/dryer laundry appliance, comprising:

a cabinet defining an interior volume;

a tub mounted within the interior volume of the cabinet;

a laundry basket rotatably mounted within the tub, the laundry basket defining a chamber for the receipt of laundry articles;

a dryer system coupled to the tub, the dryer system in fluid communication with the chamber, the dryer system configured to receive a flow of fluid from the chamber and remove moisture from the flow of fluid and provide dried air to the chamber; and a controller, the controller configured to store instructions that, when executed, causes the controller to execute operations, the operations comprising:

performing, at the laundry basket, a spin cycle corresponding to a wash cycle, wherein performing the spin cycle comprises rotating the laundry basket up to a wash cycle maximum spin speed greater than a dryer cycle maximum speed;

determining whether a spin cycle failure has occurred during the spin cycle;

ceasing the spin cycle after spin cycle failure is determined;

rotating the laundry basket at a drying cycle speed after ceasing the spin cycle based on the determined spin cycle failure, wherein rotating the laundry basket at the drying cycle speed generates a flow of air through the chamber and the dryer system;

operating a compressor of the dryer system to heat the flow of air for a predetermined period of time while rotating the laundry basket at the drying cycle speed and without operating a blower of the dryer system;

completing the spin cycle after the spin cycle failure condition is removed; and performing a drying cycle after completing the spin cycle, wherein performing the drying cycle comprises operating the compressor and the blower of the drying system.

2. The combination washer/dryer laundry appliance of claim 1, wherein rotating the laundry basket at the drying cycle speed comprises rotating the laundry basket up to the dryer cycle maximum speed less than the wash cycle maximum spin speed.

3. The combination washer/dryer laundry appliance of claim 1, wherein performing the spin cycle generates a flowrate of air through the dryer system less than a flowrate of air generated when rotating the laundry basket at the drying cycle speed.

4. The combination washer/dryer laundry appliance of claim 1, wherein performing the drying cycle after completing the spin cycle comprises operating a blower, a compressor, and an evaporator of the dryer system to heat the flow of air provided to the chamber at the laundry basket.

5. The combination washer/dryer laundry appliance of claim 1, wherein rotating the laundry basket at drying cycle speed comprises rotating the laundry basket up to the dryer cycle maximum speed.

6. The combination washer/dryer laundry appliance of claim 1, the operations comprising performing one or more iterations of ceasing the spin cycle after spin cycle failure is determined, rotating the laundry basket at the drying cycle speed after ceasing the spin cycle based on the determined spin cycle failure, and operating the compressor of the dryer system to heat the flow of air, until the spin cycle failure condition is removed.

7. A method for operating a combination washer/dryer laundry appliance, the combination washer/dryer including a cabinet defining an interior volume, a tub mounted within the interior volume of the cabinet, a laundry basket rotatably mounted within the tub, the laundry basket defining a chamber for the receipt of laundry articles, and a dryer system coupled to the tub, the dryer system in fluid communication with the chamber, the dryer system configured to receive a flow of fluid from the chamber and remove moisture from the flow of fluid and provide dried air to the chamber, the method comprising:

performing, at the laundry basket, a spin cycle corresponding to a wash cycle, wherein performing the spin cycle comprises rotating the laundry basket up to a wash cycle maximum spin speed greater than a dryer cycle maximum speed;

determining whether a spin cycle failure has occurred during the spin cycle;

ceasing the spin cycle after spin cycle failure is determined;

rotating the laundry basket at a drying cycle speed after ceasing the spin cycle based on the determined spin cycle failure, wherein rotating the laundry basket at the drying cycle speed generates a flow of air through the chamber and the dryer system;

operating a compressor of the dryer system to heat the flow of air for a predetermined period of time while rotating the laundry basket at the drying cycle speed and without operating a blower of the dryer system;

completing the spin cycle after the spin cycle failure condition is removed; and performing a drying cycle after completing the spin cycle, wherein performing the drying cycle comprises operating the compressor and the blower of the drying system.

8. The method of claim 7, wherein performing the drying cycle after completing the spin cycle comprises operating a blower, a compressor, and an evaporator of the dryer system to heat the flow of air provided to the chamber at the laundry basket.

9. The method of claim 7, wherein rotating the laundry basket at drying cycle speed comprises rotating the laundry basket up to the dryer cycle maximum speed.

10. The method of claim 7, wherein performing the spin cycle generates a flowrate of air through the dryer system less than a flowrate of air generated when rotating the laundry basket at the drying cycle speed.

11. The method of claim 7, the method comprising performing one or more iterations of ceasing the spin cycle after spin cycle failure is determined, rotating the laundry basket at the drying cycle speed after ceasing the spin cycle based on the determined spin cycle failure, and operating the compressor of the dryer system to heat the flow of air, until the spin cycle failure condition is removed.

* * * * *